US006206722B1

(12) United States Patent
Ko et al.

(10) Patent No.: US 6,206,722 B1
(45) Date of Patent: Mar. 27, 2001

(54) MICRO CONNECTOR ASSEMBLY AND METHOD OF MAKING THE SAME

(75) Inventors: David Tso-Chin Ko, Thousand Oaks; Jim Zhao, Mission Viejo; Eric Juntwait, Irvine, all of CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/441,638

(22) Filed: Nov. 16, 1999

Related U.S. Application Data

(63) Continuation-in-part of application No. 09/350,942, filed on Jul. 9, 1999.

(51) Int. Cl.[7] ..... H01R 4/24
(52) U.S. Cl. ..... 439/417
(58) Field of Search ..... 439/425, 391, 439/418, 417

(56) References Cited

U.S. PATENT DOCUMENTS 5,415,562 * 5/1995 Matsumoto et al. ..... 439/417
5,536,182 * 7/1996 Atoh et al. ..... 439/417
5,871,369 * 2/1999 Obayashi et al. ..... 439/495

* cited by examiner

*Primary Examiner*—Gary F. Paumen
(74) *Attorney, Agent, or Firm*—Wei Te Chung

(57) ABSTRACT

A micro coaxial cable connector assembly for contact with a mating electrical connector, includes a first and second housing means, a cable set with a plurality of cables, and a plurality of contacts. The first and second housing members are efficiently and durably retained together by means of the cooperation between a pair of channels and latch portions thereof and the interference fit of first retention sections and second retention sections of the contacts with a plurality of grooves and the passageways thereof. The cable set consists of the juxtaposed cables each having at least a signal segment and a grounding segment, and a grounding bar defined with two plates soldered with the grounding segments of the cables. Each passageway is equipped with multi-directional orientating means for convenience of soldering the signal segment of the cable with the tail section of the corresponding contact via an external tool. A method of making the cable connector assembly is introduced for convenience of the assembly.

1 Claim, 17 Drawing Sheets

MICRO CONNECTOR ASSEMBLY AND METHOD OF MAKING THE SAME

This application is a continuation-in-part of U.S. patent application No. 09/350,942 filed on Jul. 09, 1999

BACKGROUND OF THE INVENTION

1. Field of the Invention

The present invention relates to a micro connector assembly for link with a remote micro coaxial cable, and particularity to a micro connector assembly for electrical and mechanical contact with an external mating connector.

2. The Prior Art

In a conventional micro connector as introduced in U.S. Pat. No. 5,871,369 and Japanese Patent Publication No. 09-055243, a plurality of conductive cores 21 through 26 of a flat cable 17 are respectively fitted into several notches 31 through 36 defined inside a main body 10 of the connector 1. An elongated contact bar 18 composed of an insulating material is then placed inside a groove 28 of the main body 10 defined perpendicular to a longitudinal axis of each notch 31 thereby locating above the conductive cores 21 through 26 in perpendicular relationship. Eventually, an insulative cover 19 is restrainedly attached above the main body 10 to press down the conductive cores 21 through 26 via the contact bar 18. Thus, the conductive cores 21 through 26 each relatively deflects down a spring contact arm 14*a* of one of the contacts 14 in a main body 10 of the connector 1 thereby establishing electrical connection between the cable 17 and the contacts 14.

However, such a said connector has poor mechanical connection with the cable because of the absence of an efficient horizontal retention means to prevent the separation of the cable from connector or the conductive cores of the cable from cable after action of an excessive withdrawing force thereon. Furthermore, during the process of the moveable installation of the cover 19 within the main body 10, a permanent deformation may happen in either of the spring contact arms 14*a* due to improper operation. The minimized dimension and flexibility of the conductive cores will increase difficulty and inconvenience of the assembly with the corresponding notches 31 of the main body 10 or the poor engagement with the contact arm 14*a* under the absence of an orientation means thereon.

Another conventional design on the micro type connector like Japanese Patent Publication Nos. 10-321314 and 10-255921 introduces that a cable holder of the connector defines a row of U-shaped grooves at a front end for reception of the corresponding conductive cores of the coaxial cable therein. When the grooves of the cable holder are respectively fitted and inserted between a tuning fork type tips of the corresponding contact, the upper and lower side tips of the contacts are brought to press down the conductive cores on one side/reversed sides of the U-shaped grooves. However, the fork type tips of the contact or the conductive cores are easily damaged or permanently deformed due to tight fit therebetween resulting from restriction of a housing where the contacts are received. The tight fit is still insufficient to firmly retain the cable holder with the housing, especially in exercise of an excessive full force on the cable.

The instant application is a continuation-in-part of U.S. patent application No. 09/350,942 filed on Jul. 09, 1999 which discloses a first and second housing members, a cable set with a plurality of cables, and a plurality of contacts. The second housing member defines a plurality of passageways each with a pair of protrusions on opposite lateral sides thereof. Thus, a signal segment of each of the cables is precisely positioned above a tail section of the corresponding contact within the corresponding passageway by way of orientating of the protrusions. Then, the signal segment of the cable is soldered with the tail section of the corresponding contact together.

Although the protrusions expedite the orientation of the signal segment of the cable within the corresponding passageway. It is hard to inspect whether the signal segment of the cable and the tail section of the corresponding contact in each passageway are efficiently engaged with each other before being soldered together.

SUMMARY OF THE INVENTION

Accordingly, one object of the present invention is to provide an improved micro connector assembly for easily and firmly linking with a plurality of micro coaxial cables.

Another object of the present invention is to provide an orientation means formed within several passageways of a rear housing member of the connector so as to accurately and speedily placing a plurality of conductive cores within the corresponding passageways.

Another object of the present invention is to provide a cable set used with the micro connector and a method of making the same for convenience and ease of the manufacture.

Another object of the present invention is to provide a method of speedily making the micro connector assembly.

Another object of the present invention is to provide a structure of the micro connector assembly equipped with multi-directional orientating means for convenience of soldering the conductive core of the cable with a tail section of the corresponding contact via an external tool.

To fulfill the above mentioned objects, according to several embodiments of the present invention, a micro coaxial cable connector, includes a first and second housing means, a cable set with a plurality of cables, and a plurality of contacts. The first housing member includes a plurality of grooves horizontally extending therein and a pair of channels with swellings. Each contact consists of a contact section at a free end for electrical contact with the mating connector, a first retention section at a middle region, a tail section at an opposite end, and a second retention section formed on the tail section. The cable set consists of the juxtaposed cables and the grounding bar. Each cable includes a signal segment at a free end thereof and a grounding segment insulated and seriated with the signal segment. The grounding bar consists of an upper and lower conductive plates perpendicularly soldered with the grounding segment of each of the cables. The second housing member defines a plurality of passageways, a pair of latch portions with bow sections, and a pair of spaced orientating walls adjacent to a rear portion of the passageways thereby constituting an elongated slot for receiving the grounding bar jointed with the cables therein. Each passageway further forms a pair of protrusions on opposite lateral sides thereof for cooperation with said second retention section of the contact. An orientating raise is selectively disposed at a rear of each of the passageways to orient the grounding segment of each of the cables in front-and-rear direction. Also, an elongated slit optionally extends transversely and normally of the protrusions on the lateral sides of the passageways thereby constituting an entrance of an external tool that is used to ensure the engagement of the tail sections of the contacts with the signal segments of the corresponding cables.

A method of making the cable connector comprises the steps of firmly retaining the tail section of each of the contact inside the corresponding passageway by the interference fit of the second retention section therewith but exposing the contact section and the first retention section outside the second housing member, and placing the cable set inside the slot of the second housing member, and orienting the signal segment of each of the cables above the tail section of the corresponding contact within the corresponding passageway by the pair of protrusions, and using the external tool to depressingly engage the signal segment with the tail section through the slit and then removing the external tool out of the slit, and easily soldering the signal segment of each of the cables with the tail section of the corresponding contact together, and inserting the second housing member into the first housing member until the first retention sections are interference fitted with the grooves of the first housing member or abut against a stopper wall formed on an outlet of each of the grooves.

DETAILED DESCRIPTION OF THE PREFERRED EMBODIMENTS

Detailed reference will now be made to the preferred embodiments of the present invention.

Figure 1:
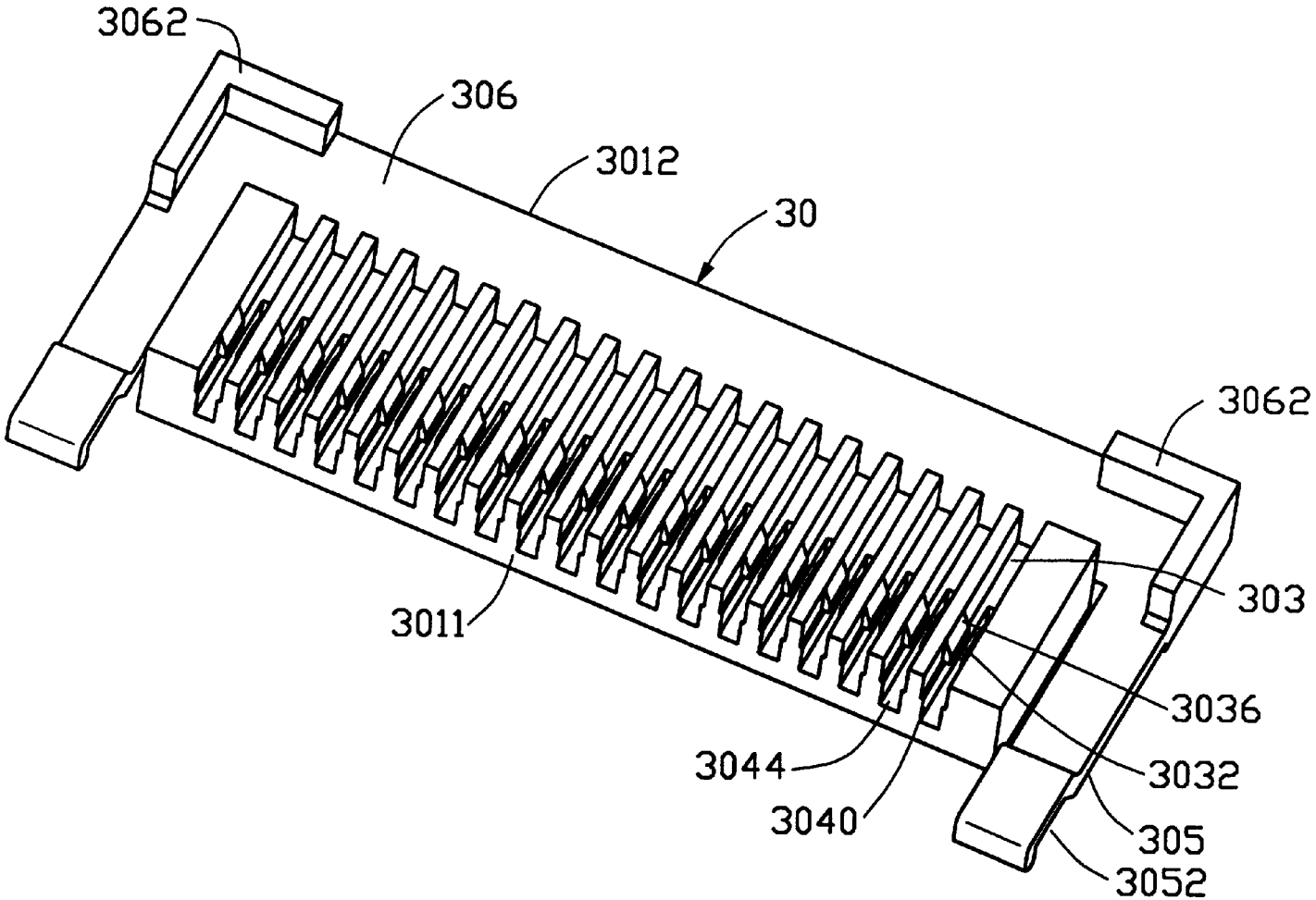
FIG. 1 is a front perspective view of a rear housing member of a micro connector assembly in accordance with a preferred embodiment of the present invention.

Referring first to FIG. 1, a rear housing member 30 of a micro coaxial connector assembly in accordance with a first embodiment of the present invention has opposite surfaces 3011, 3012 at a front-to-rear direction thereof. A row of spaced passageways 303 adjacent to the front surface 3011 are juxtaposed along a longitudinal axis of the member 30 and inward terminate at a predeterminated position. Each passageway 303 is defined with opposite lateral walls, each lateral wall divided into an upper and lower portion, and a bottom wall located between the lower portions of the lateral walls. A cave 3044 adjacent to the front surface 3011 is defined on the bottom wall of each passageway 303. A pair of protrusions 3032 are formed at the upper portions of opposite lateral walls of each passageway 303 and horizontally extend toward each other to define a specific interval 3038 therebetween. Each protrusion 3032 downwardly extends until terminating at an underside 3040 spaced apart from the cave 3044. A slope surface 3036 is formed at a top tip of each of the protrusions 3032. A pair of L-shaped orientating walls 3062 are respectively located at opposite corners adjacent to the rear surface 3012 to constitute an elongated slot 306 therebetween. A pair of latch portions 305 extend behind the front surface 3011 from said orientating walls 3062. A facing-down bow section 3052 is formed at a free end of each of the latch portion 305.

Figure 2:
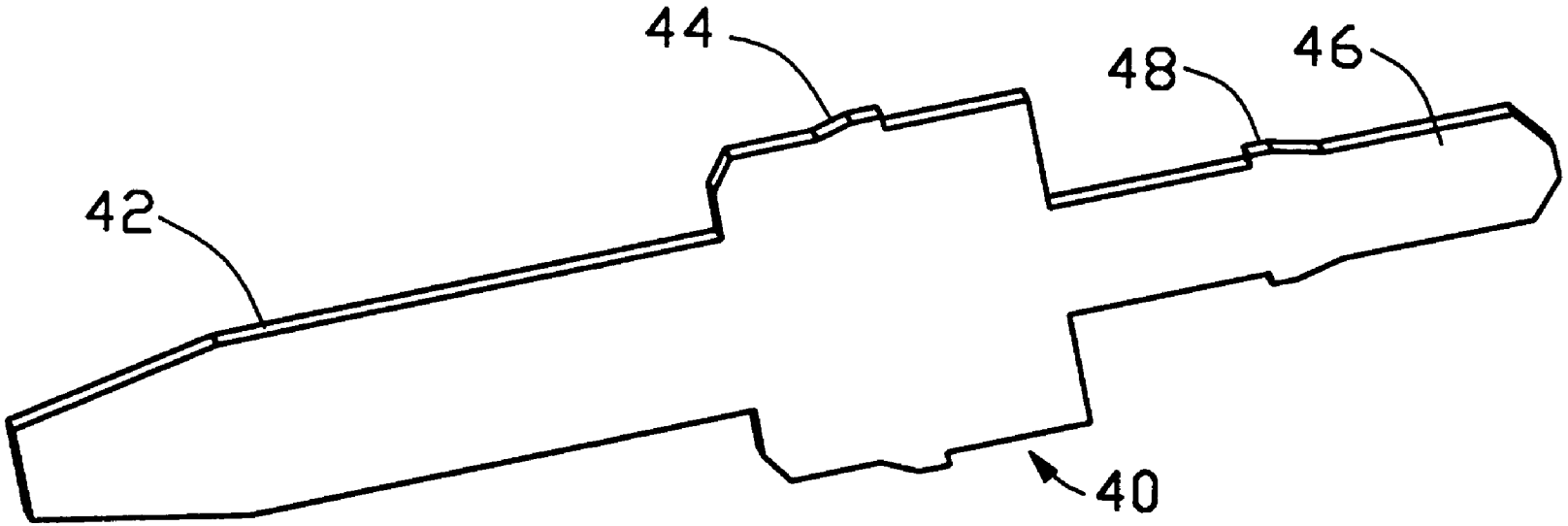
FIG. 2 is a front perspective view of a contact of the micro connector assembly according to the present invention.

Further referring to FIG. 2, a single tip type contact 40 consists of a contact section 42 at a free end thereof, a fins type first retention section 44 with a pair of barbs at a middle region thereof, and a tail section 46 with a barb-like second retention section 48 at opposed end thereof.

Figure 3:
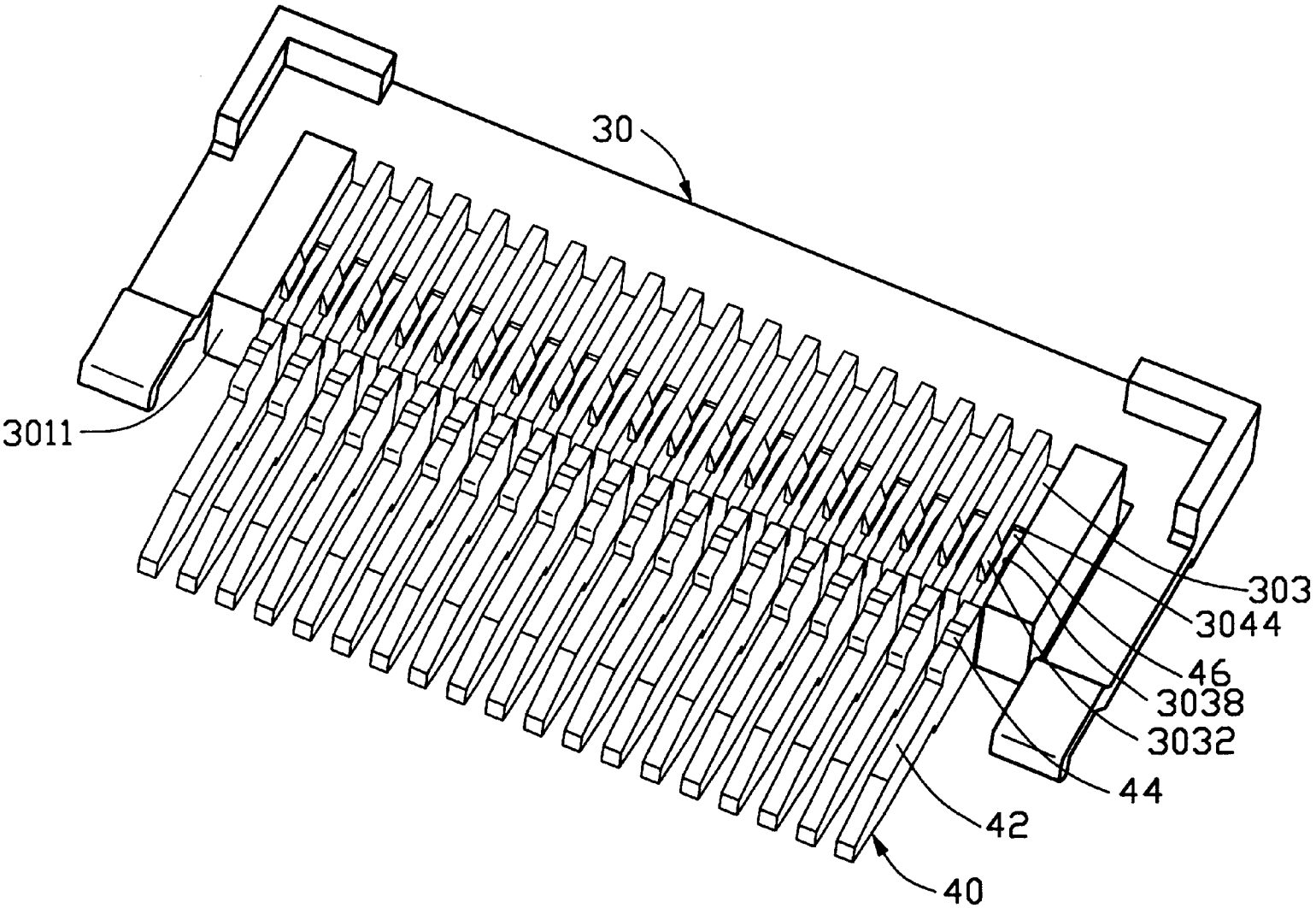
FIG. 3 is an assembled perspective view of the rear housing shown in FIG. 1 with the contacts shown in FIG. 2.

In subassembly shown in FIG. 3, the tail section 46 of the contacts 40 are respectively inserted horizontally between the cave 3044 and the protrusions 3032 of the corresponding passageways 303, via the front surface 3011 of the rear housing member 30. Further the second retention section 48 of each of the tail sections 46 is interference fitted with the underside 3040 of the protrusion 3032. Each of the contacts 40 exposes both the contact section 42 and the first retention contact 44 outside the front surface 3011 of the main body 30.

Figure 4:
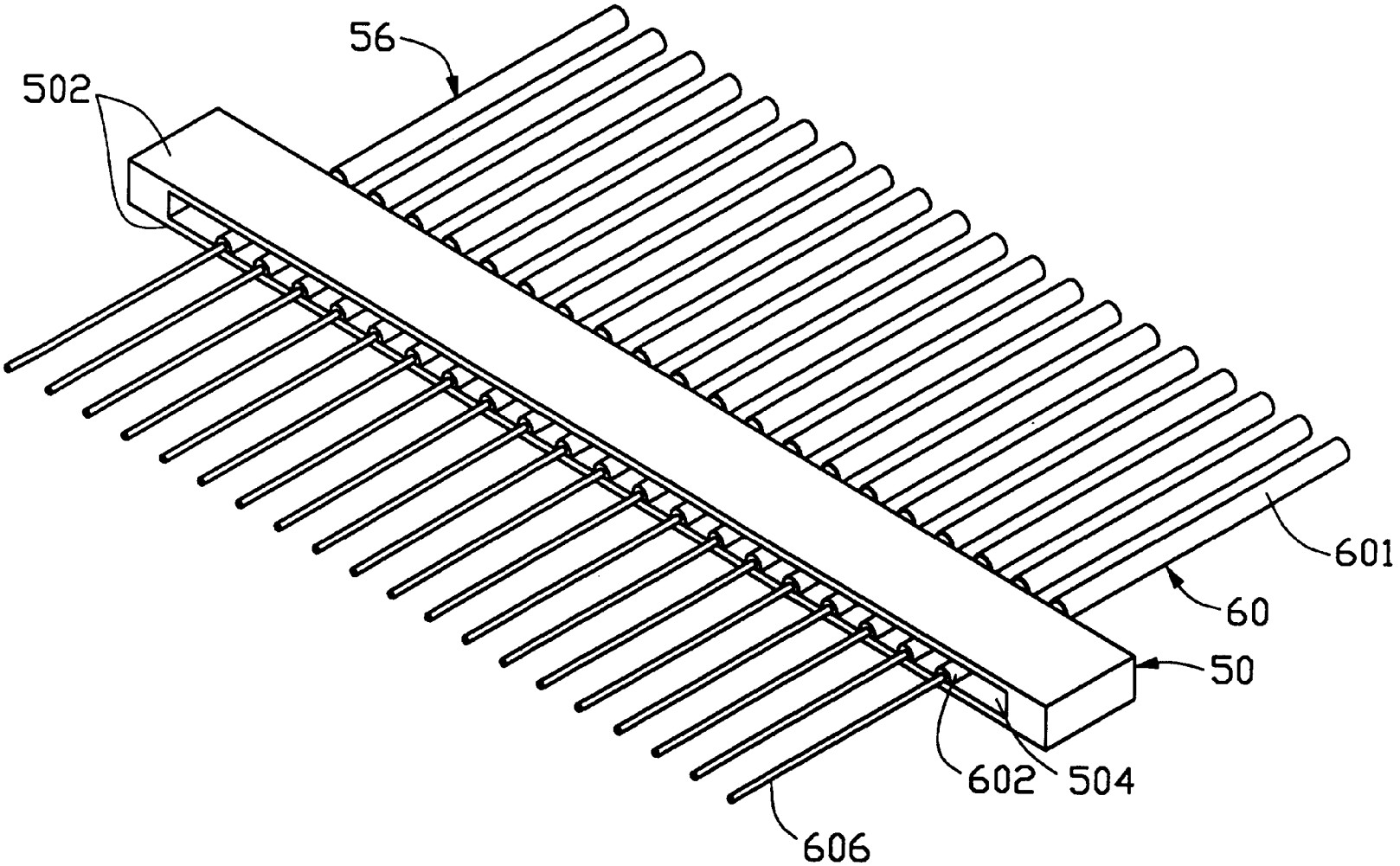
FIG. 4 is a front perspective view of a cable set of the micro connector assembly according to the first preferred embodiment of the present invention.

A micro coaxial cable set 56 as shown in FIG. 4 consists of a row of juxtaposed coaxial round cables 60 and a grounding bar 50. Each cable 60 is composed of a first insulative layer 601 at the outermost thereof, a conductive jacket layer 602 formed below the first insulative layer 601, a second insulation layer 604 (See FIGS. 5 & 6) formed below the jacket layer 602 and a conductive core 606 at the innermost thereof.

The grounding bar 50 is defined with an upper and lower metal plates 502 fixedly jointed at opposite ends thereof and a crack 504 separating both plates 502 from each other. In subassembly of the cable 60 with the grounding bar 50, each cable 60 perpendicularly extends through the crack 504 of the grounding bar 50 and clamped between the plates. The outermost insulative layer of each cable 60 in part is stripped off to expose the jacket layer 602 as being a grounding segment of the cable 60. Then the grounding segment of each cable 60 are respectively soldered with the inner walls of the upper and bottom plates 502. The cable 60 in part is further stripped off to exposes the conductive core 606 as being signal segment which extends outside the grounding bar 50 and insulated from the grounding segment by the second insulative layer 604. However, it is noted that before the soldering process is exercised thereon, these cables 60 are fixed in position of defining a specific interval between each two cables 60 to meet the pitch of the contacts 40 by the way of applying an external tool. In consideration of the convenience of soldering process exercised between the contacts 40 and the cables 60, an indent or a plurality of compartment structure (not shown) can be designedly formed along a longitudinal axis of said inner walls of the plates 502.

Figure 5:
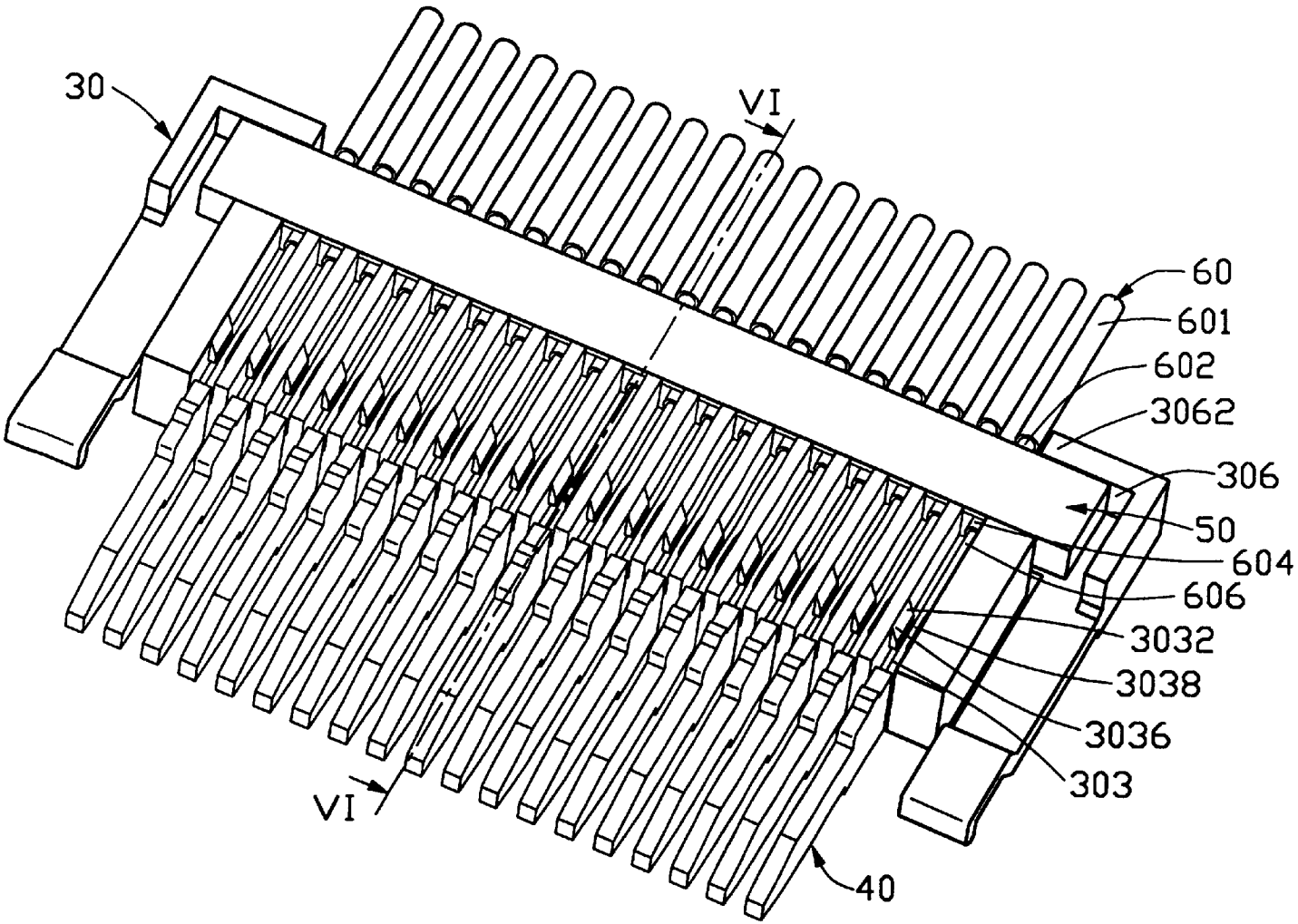
FIG. 5 is an assembled perspective view of the rear housing shown in FIG. 3 with the cable set shown in FIG. 4.
Figure 6:
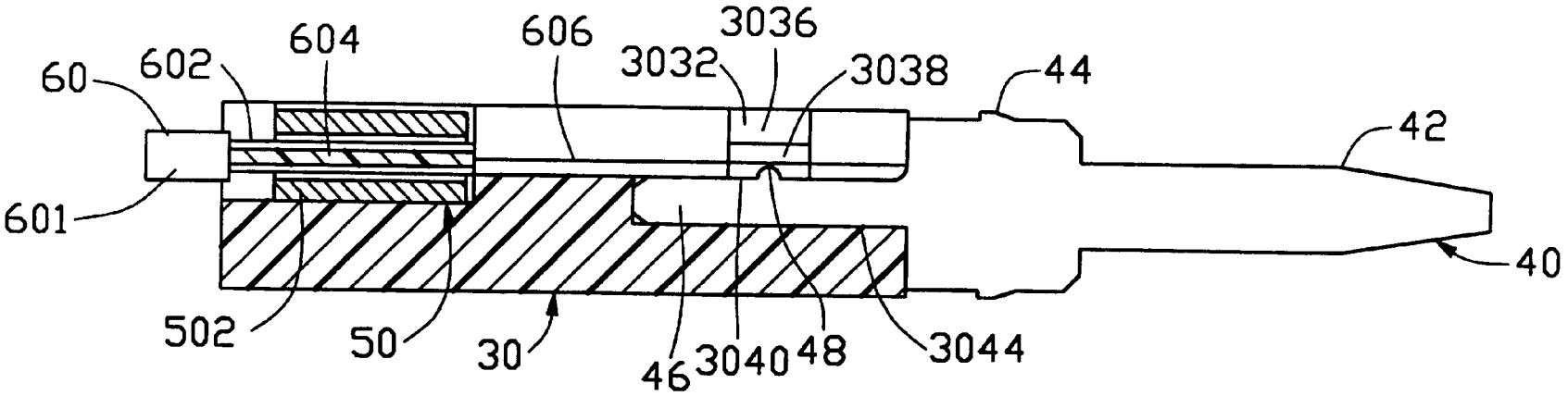
FIG. 6 is a cross-sectional view of the rear housing member taken along line VI—VI of FIG. 5.

In subassembly as shown in FIGS. 5 & 6, the grounding bar 50 of the cable set 56 is placed inside the slot 306 of the rear housing member 30 and restricted by the orientating walls 3062 from moving along a horizontal direction with respect to a surface of the rear housing member 30. One of opposite ends of each cable 601 rearward extends through the rear surface 3012 of the rear housing member 30 to link with a desired electrical device (not shown). Another end of the cable 601, a signal segment of exposing the conductive core 606, horizontally extends through the interval 3038 formed between the protrusions 3032 in the corresponding passageway 303 and above the tail section 46 of the contact 40 which is retentively received within the cave 3044 of the corresponding passageway 303. Then, a soldering process or a conductive adhesive is accurately exercised between the signal segment of the cable 60 and the tail section 46 of the contact 40 for enhancement of the electrical and mechanical connection therebetween.

As soon as the rear housing member 30 is assembled with the cable set 56, the signal segment of each cable 60 are accurately aligned with the passageways 303 because of being pre-soldered with the grounding bar 50 in the specific interval between each two adjacent cables 60 as mentioned above. By means of guidance of the slope surfaces 3036 of the protrusions 3032, the signal segment can be easily oriented within the interval 3038 between the protrusions 3032, almost equal to the diameter of the cores 606 for accurate and convenient soldering with the tail sections 46 of the contacts 40. It is noted that the opposite protrusions 3032 also are capable of restricting the melted flux from flowing out of the signal segment during the soldering process thereby raising the efficiency of soldering.

Figure 7:
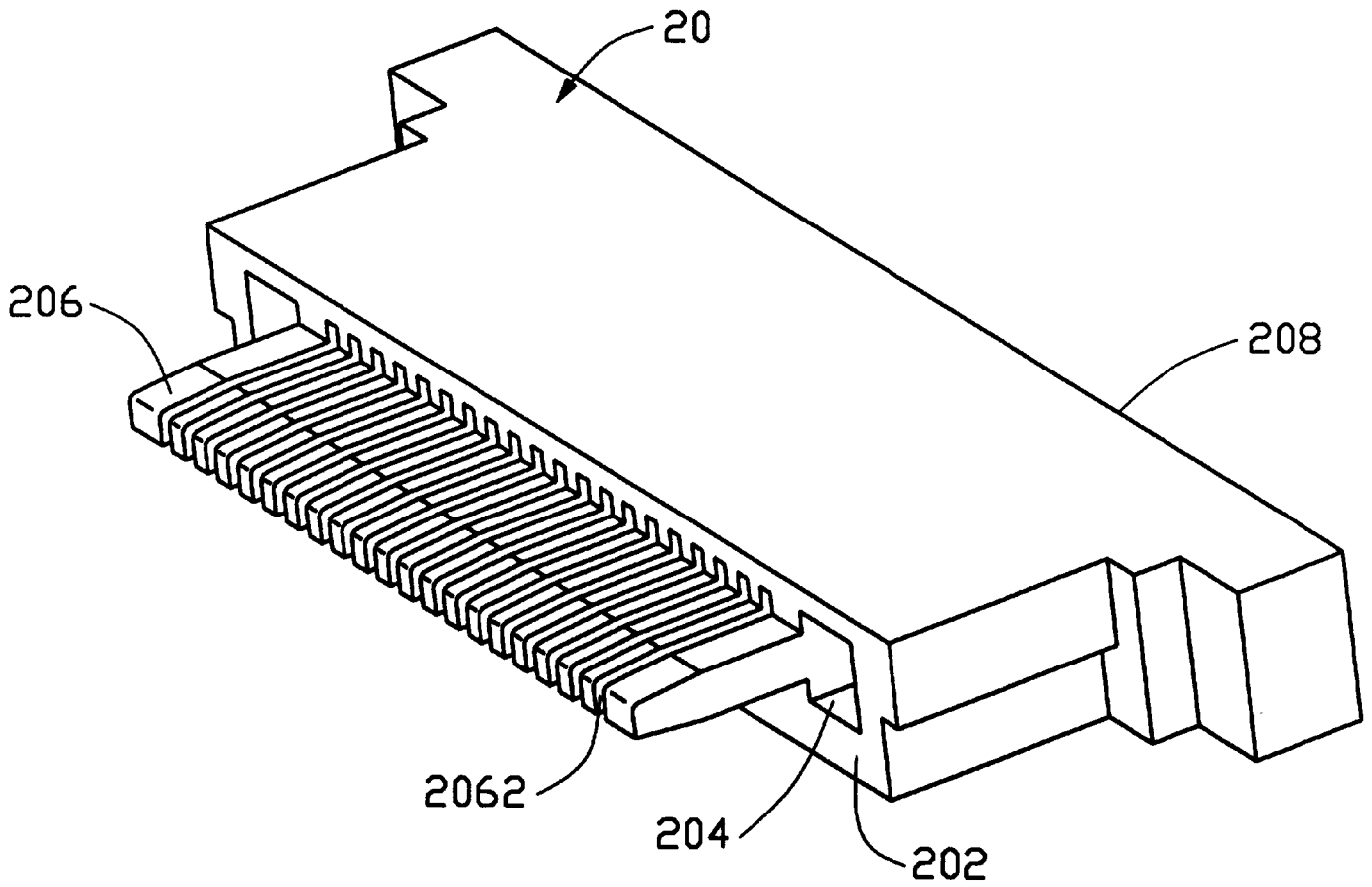
FIG. 7 is a front perspective view of a front housing member of the micro connector assembly according to the present invention.

Further referring to FIG. 7, a front housing member 20 includes a mating surface 202 for contact with an external mating connector (not shown), and a joint surface 208 opposite to the mating surface 202 for contact with said the rear housing member 30 as shown in FIGS. 5 & 6. A tongue portion 206 outwardly extend at a meddle region of the mating surface 202 for insertion into the mating connector. An opening (not shown) is defined on the joint surface 208 for entrance of the rear housing member 30. A plurality of grooves 2062 horizontally extends between a free end of the tongue portion 206 and the joint surface 208 along a front-to-rear direction. A pair of channels 204 formed at opposite lateral sides of the front housing member 20 horizontal extends through both surfaces 202 and 208. A swelling (not shown) vertically extends from a specific position of a bottom side of each of the channels 204.

Figure 8:
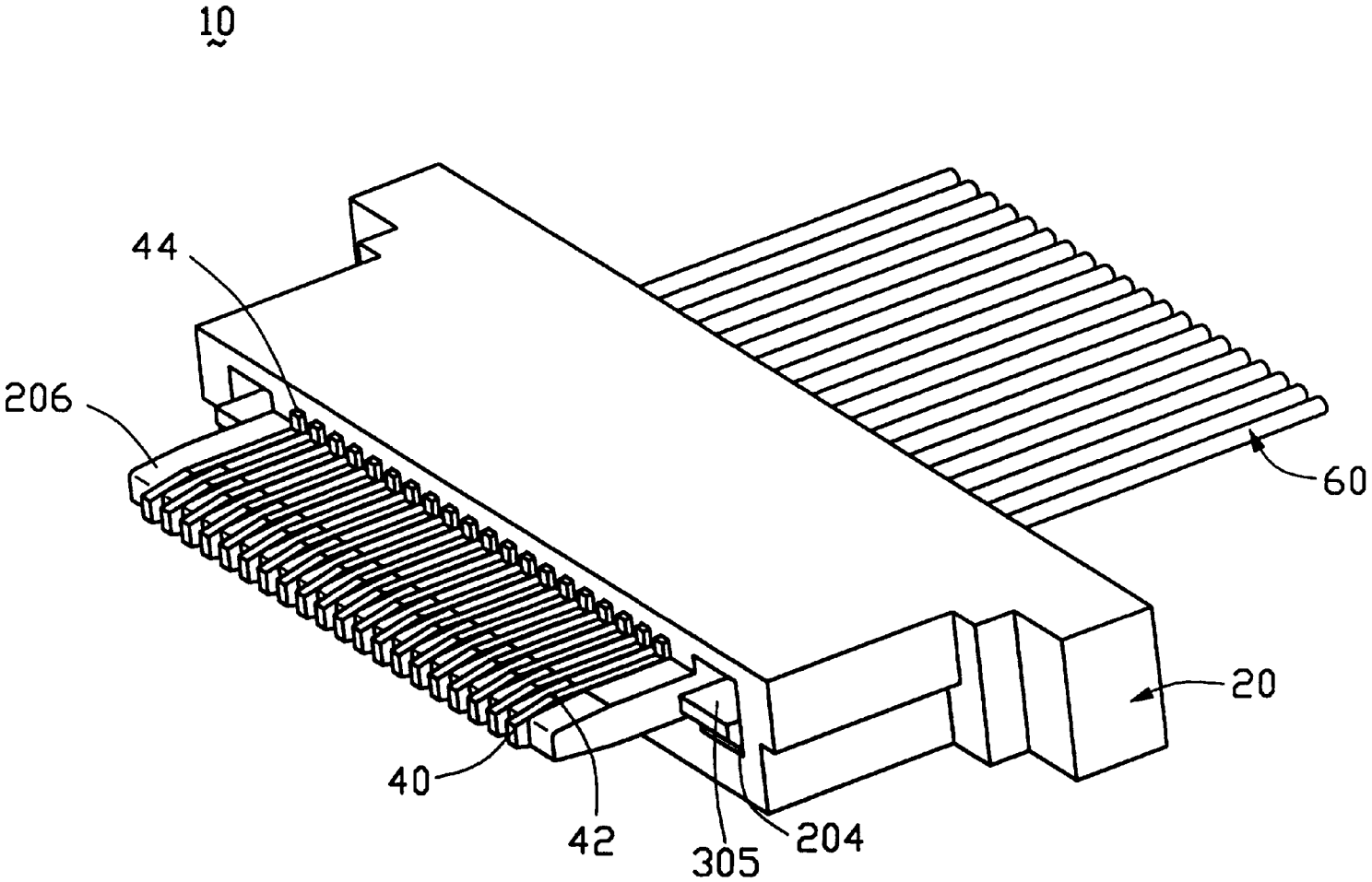
FIG. 8 is an assembled perspective view of the micro connector assembly with the front housing member shown in FIG. 7 and the rear housing member shown in FIG. 5.

In final assembly, the rear housing member 30 is inserted into the front housing member 20 from the opening of the joint surface 208 as shown in FIG. 8. The latch portions 305 of the rear housing member 30 are inserted within the channels 204 of the front housing member 20 and retained with the swellings in the channels 204 by the locking of the bow sections 3052 therewith. The contacts 40 disposed within the passageways 303 of the rear housing member 30 are respectively inserted into the corresponding grooves 2062 of the front housing member 20 and exposes the contact sections 20 outside the tongue portion 206 for electrical contact with the external mating connector. Each contact 40 is interference fitted with an upper wall of the corresponding groove 2062 by the barb-like first retention section 44 thereof.

In comparison with the prior arts that depend on the tight fit between the cables and the contacts thereof, the retention between the front and rear housing members 20 and 30 in accordance with the first embodiment of the present invention adopts the locking between the channels 204 and the latch portion 305, and the interference fit of the contacts 40 with the grooves 2062 and passageways 303. Thus, the mechanical and electrical connection between the cables 60 and the contacts 40 or between the front and rear housing members 20 and 30 can achieve higher performance than those of the prior arts.

Figure 9:
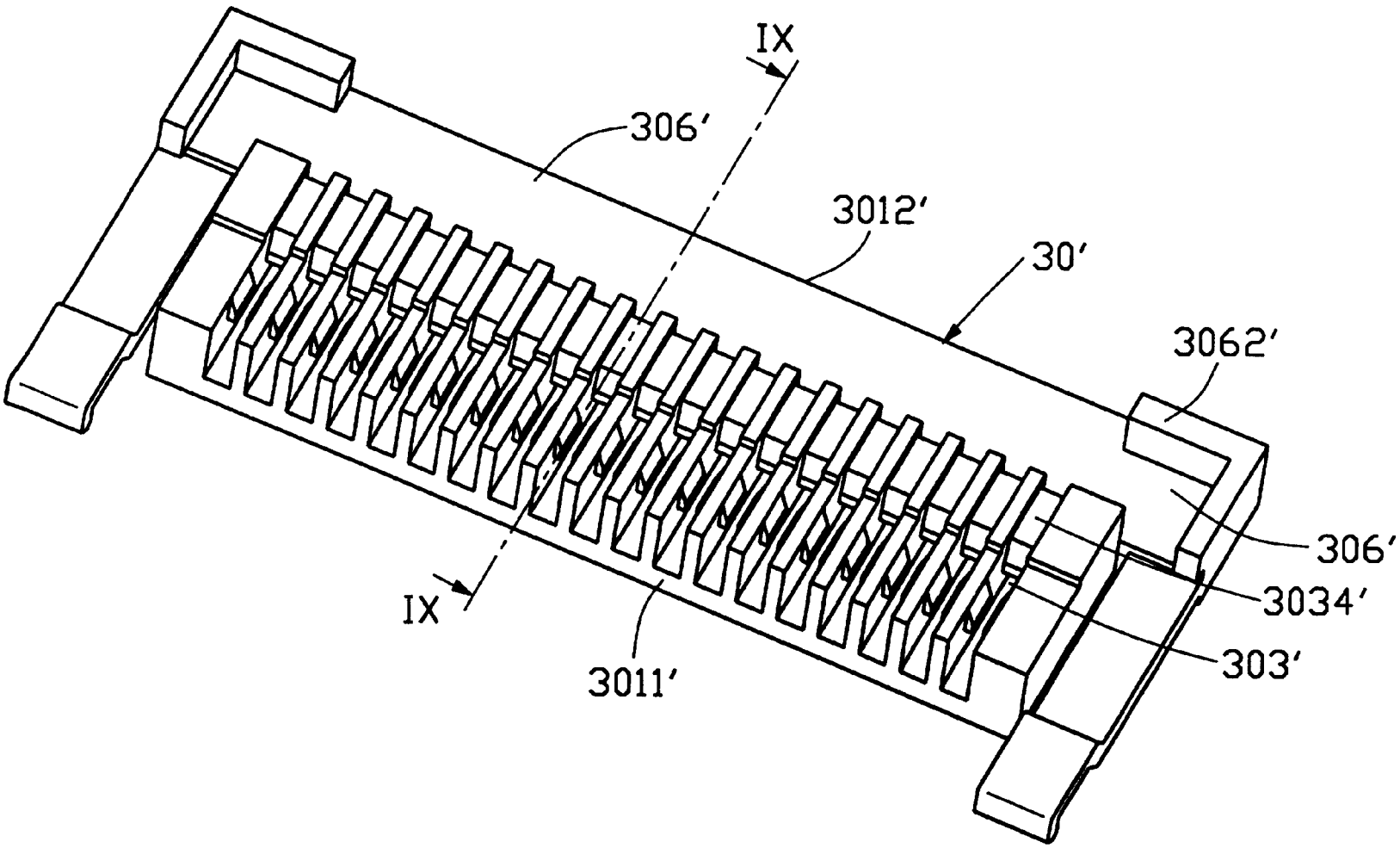
FIG. 9 shows a second embodiment of a rear housing member according to the present invention.
Figure 10:
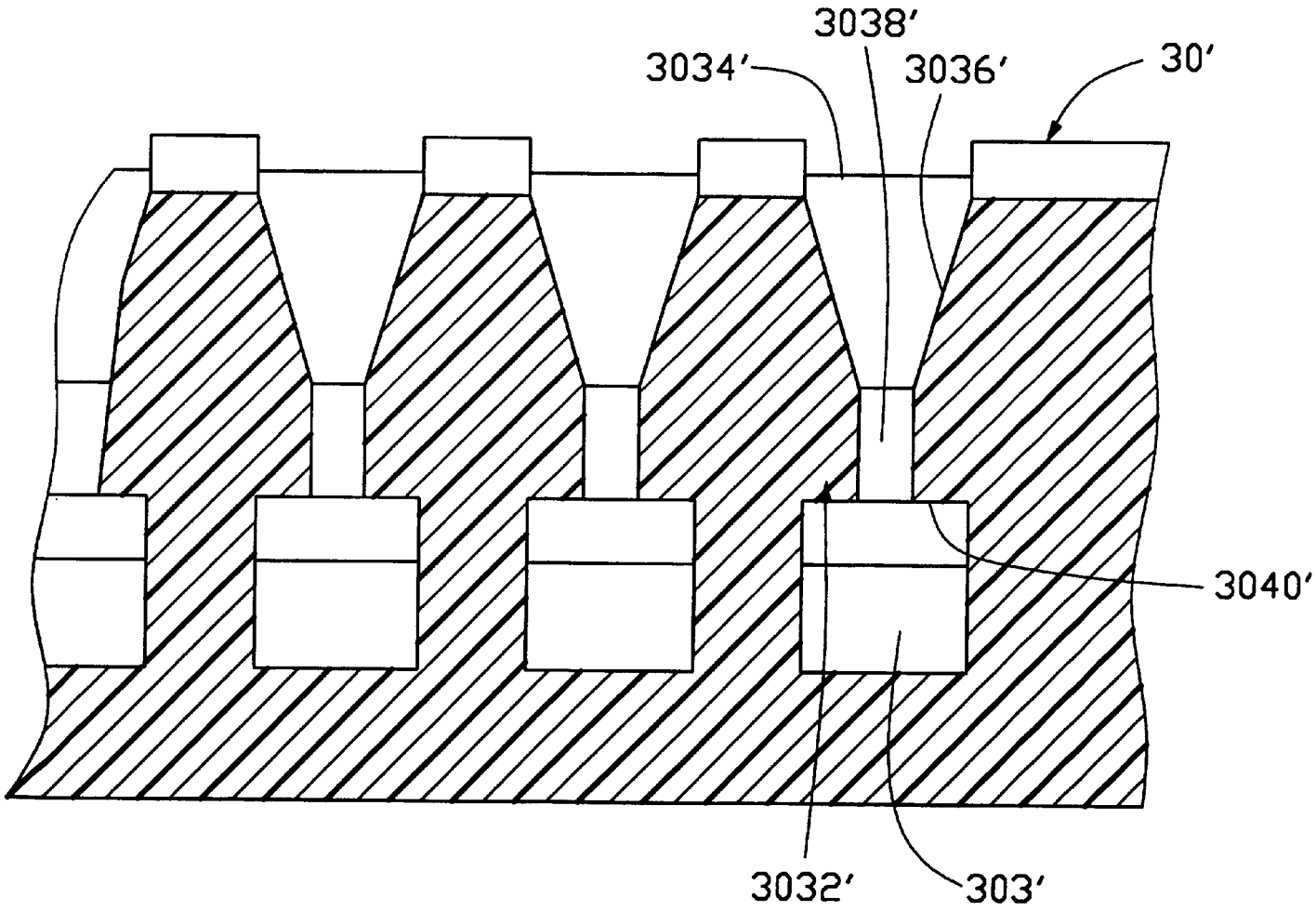
FIG. 10 is a partly cross-sectional view of the rear housing member taken along line IX—IX of FIG. 9.
Figure 11:
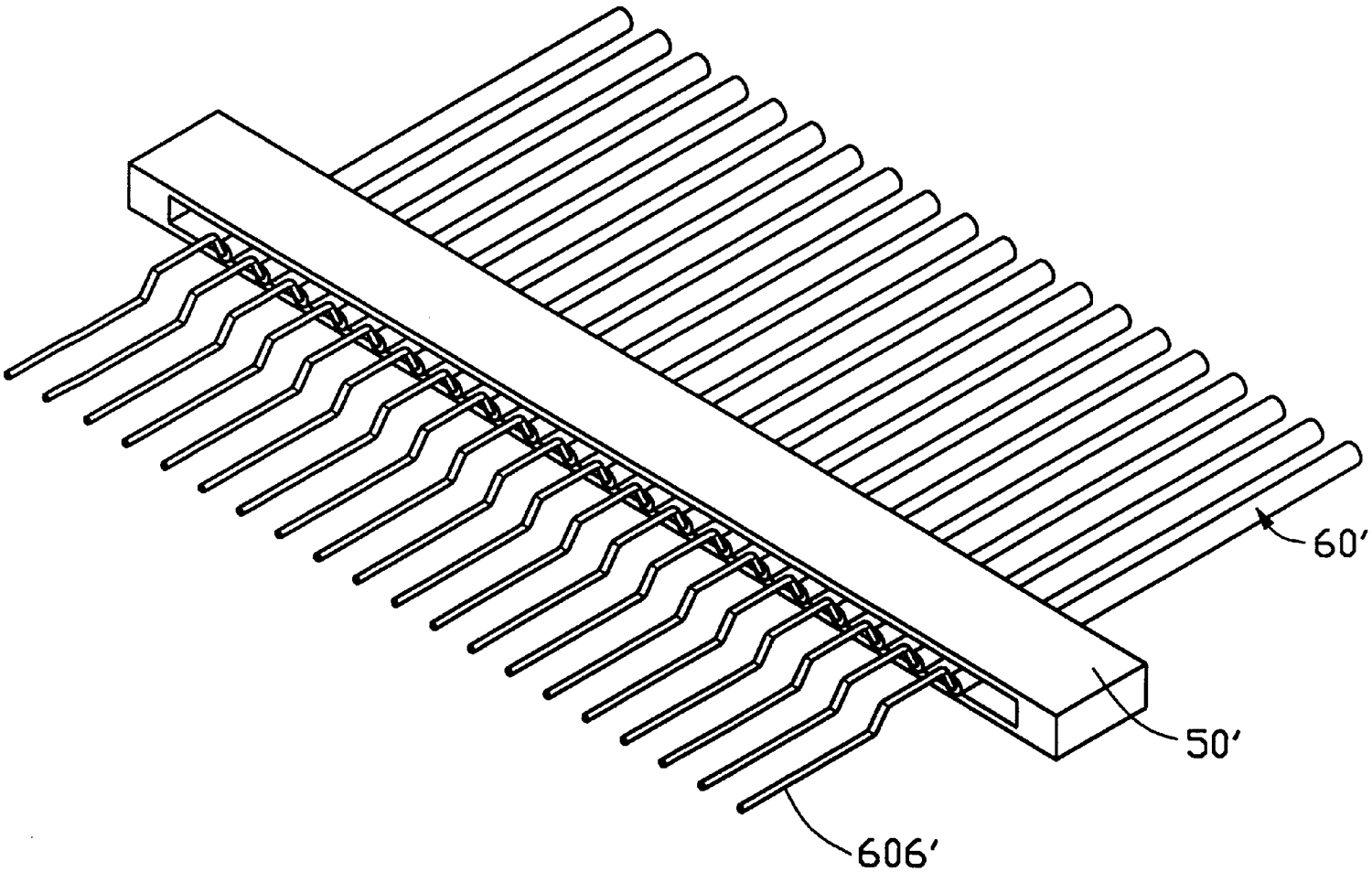
FIG. 11 is a front perspective view of a cable set of the micro connector assembly according to the second embodiment of the present invention.
Figure 12:
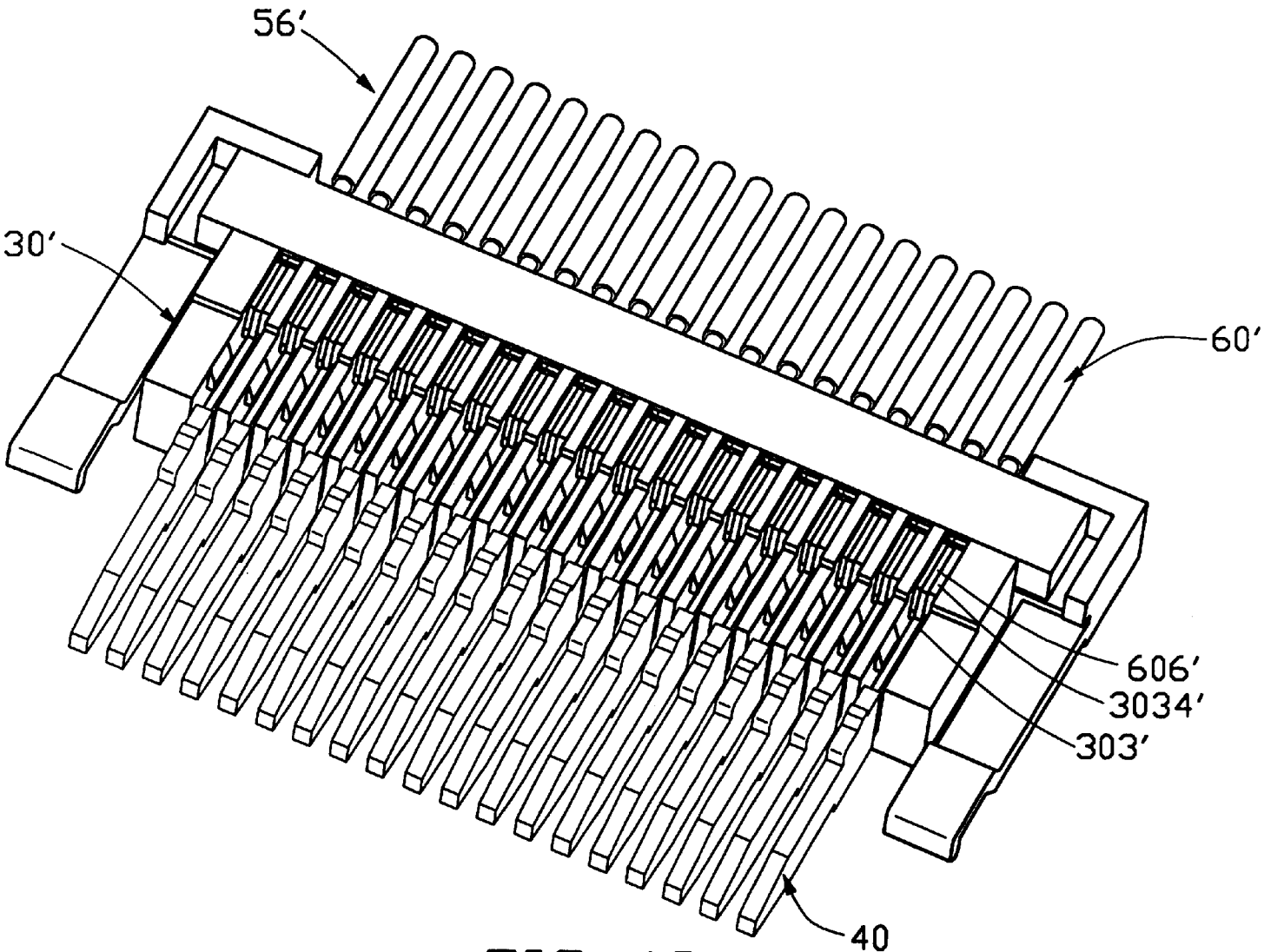
FIG. 12 is an assembled perspective view of the micro connector assembly with the rear housing member shown in FIG. 9 and the cable set shown in FIG. 11.

A second embodiment of the present invention as shown in FIGS. 9 & 10 has an orientating raise 3034' in comparison with the first embodiment. The orientating raise 3034' is formed at a rear end of each of the passageways 303' for orientation of the cable at the passageways 303' in a front-to-rear direction, especially upon a larger fitting tolerance between the grounding bar 50' (See FIG. 11) and the slot 306' of the rear housing member 30'. Relatively, a rear portion of the signal segment of the cable 60' that exposes the conductive core 606' as shown in FIG. 11 is shaped to the same contour as the orientating raise 3034' for the above-mentioned orientation as shown in FIG. 12.

Figure 13:
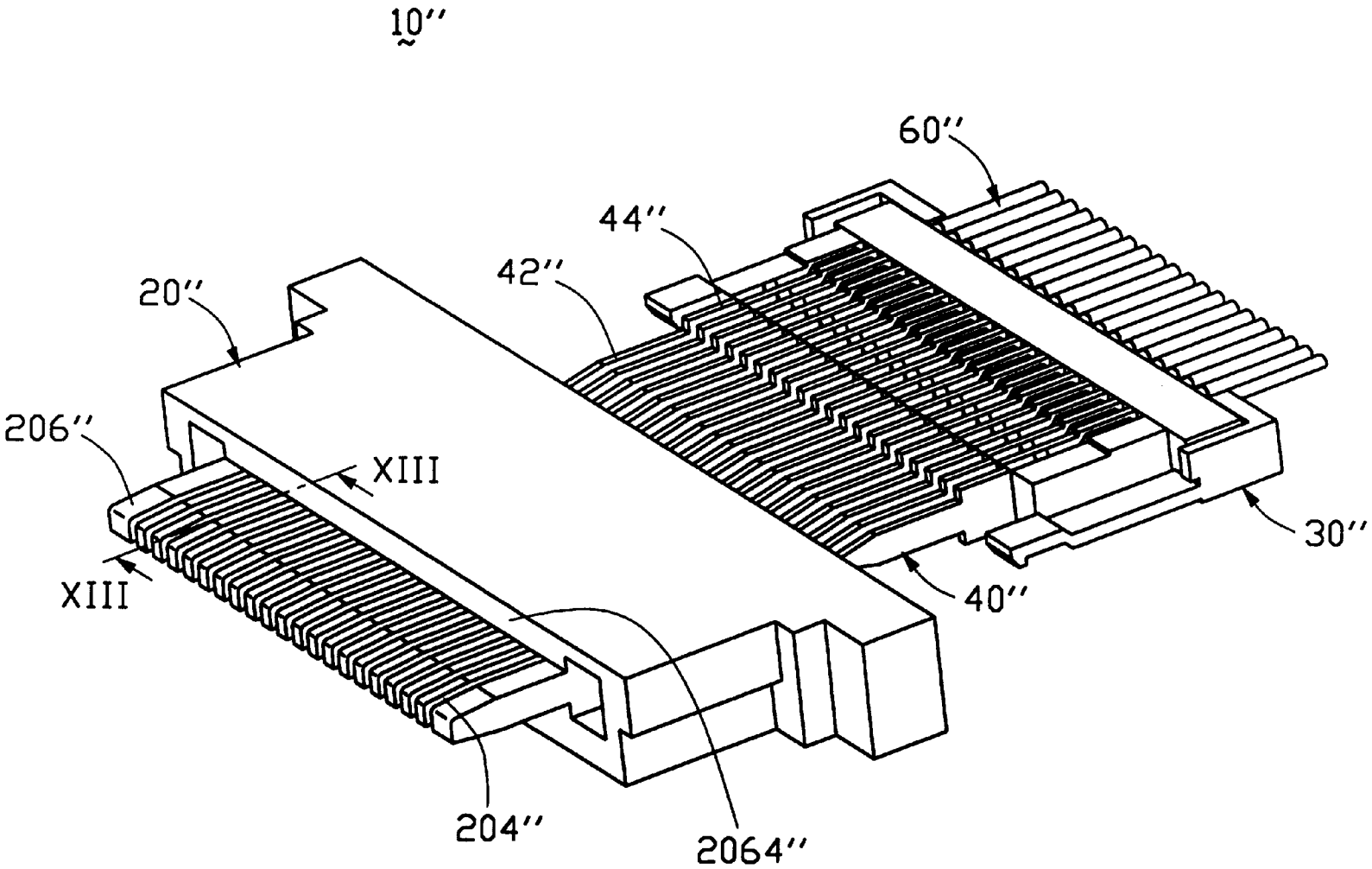
FIG. 13 shows a third embodiment of a micro connector assembly according to the present invention.
Figure 14:
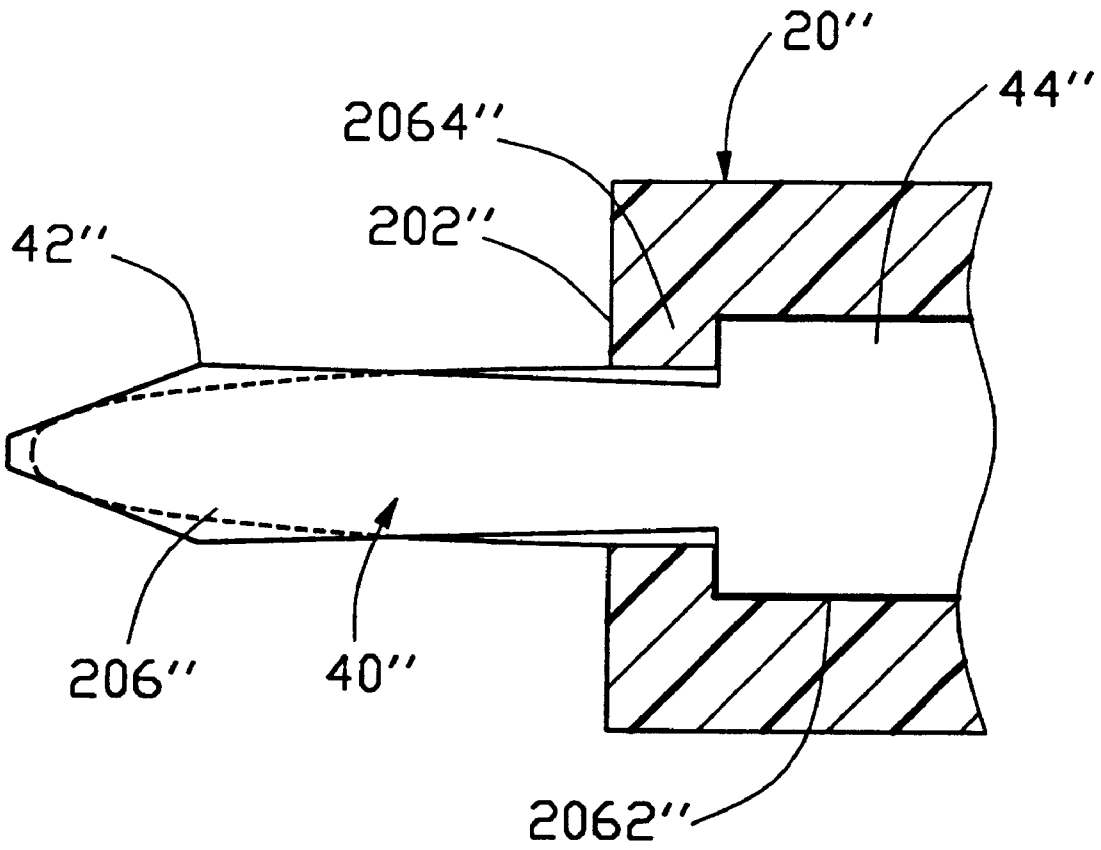
FIG. 14 is a partly cross-sectional view of the micro connector assembly taken along line XIII—XIII of FIG. 13.

A third embodiment of the present invention as shown in FIGS. 13 and 14 additionally forms a stopper wall 2064" on an outlet of each groove 2062" adjacent to the mating surface 202" of the front housing member 20". A shoulder of the first retention section 44" of the contact 40" can abut against the stopper wall 2064" as soon as being inserted into the corresponding groove 2062" thereby preventing the contacts 40" from removing out of the mating surface 202".

Figure 15:
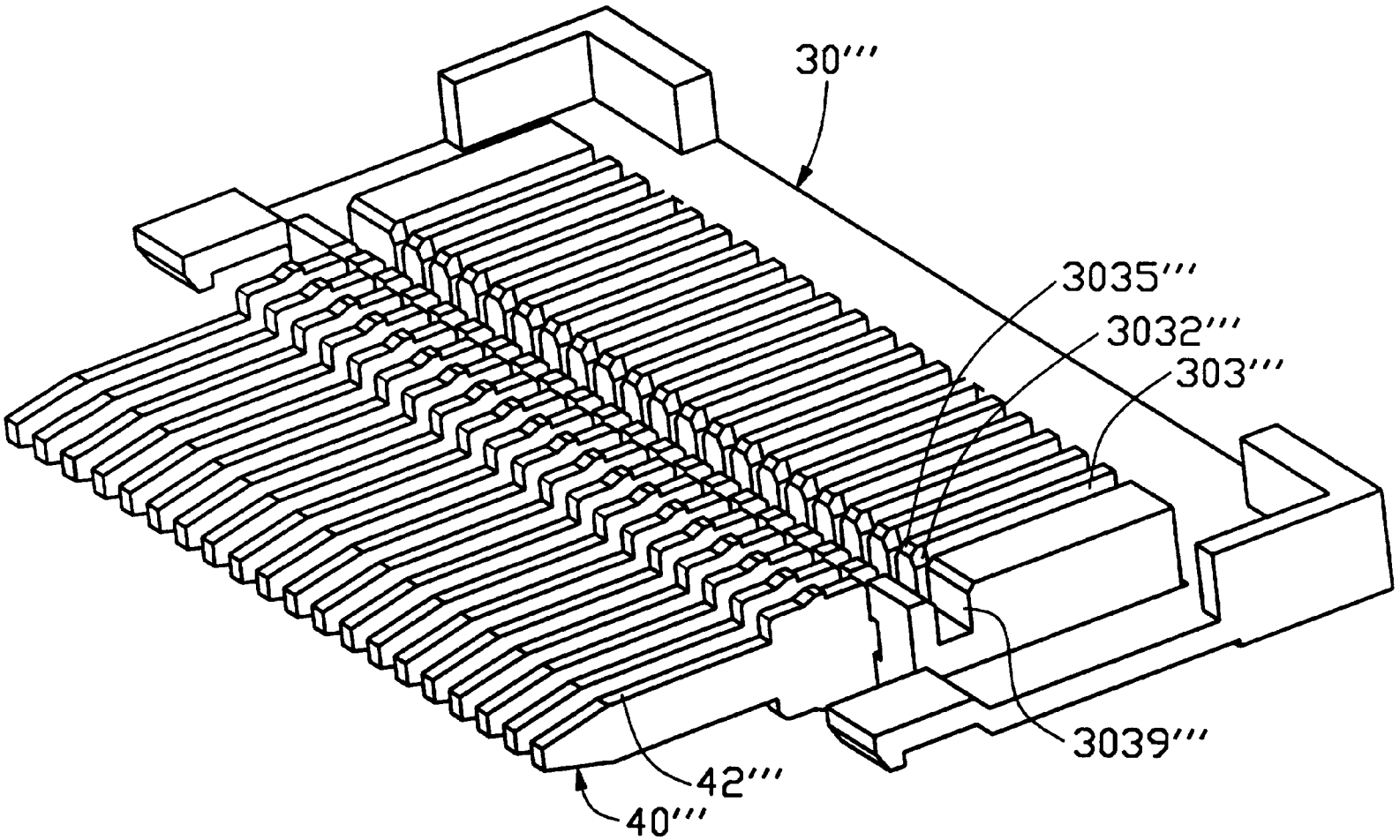
FIG. 15 shows a fourth embodiment of a rear housing member according to the present invention.
Figure 16:
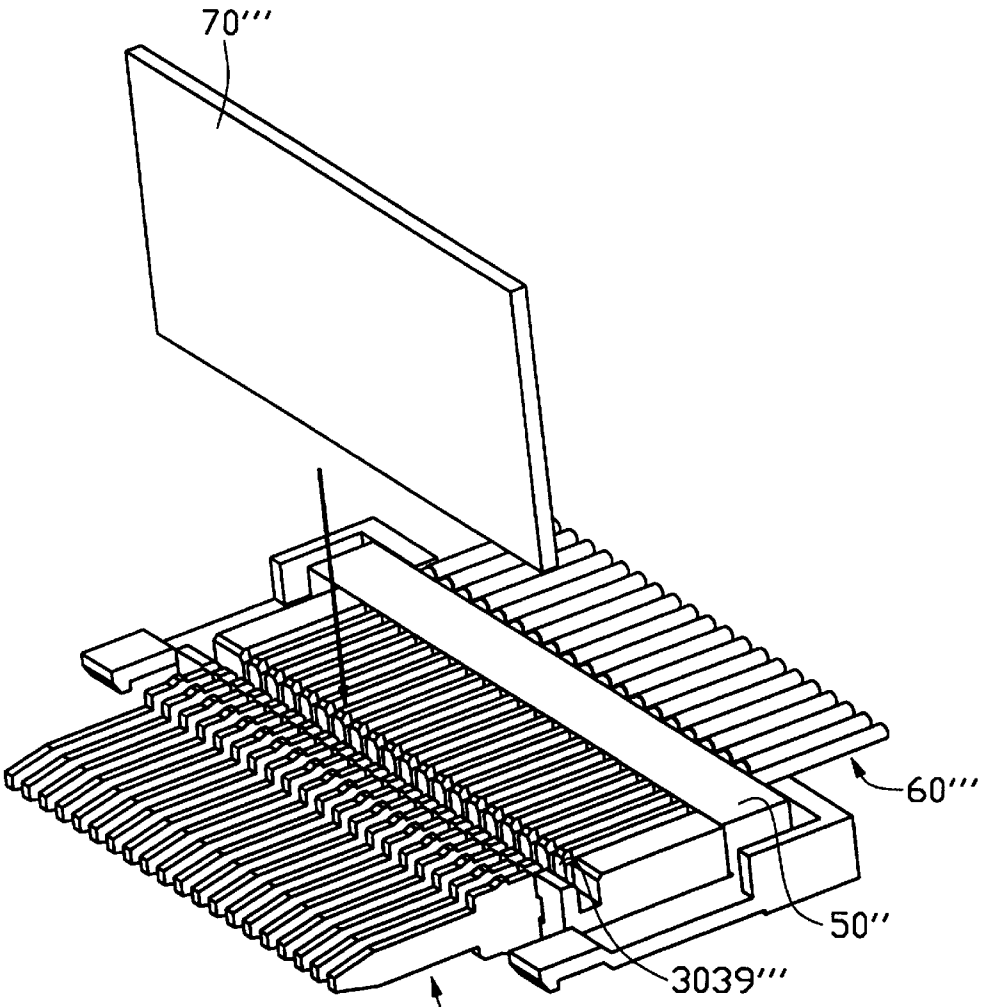
FIG. 16 is an assembled perspective view of the micro connector assembly with the rear housing member of FIG. 15 and the cable.
Figure 17:
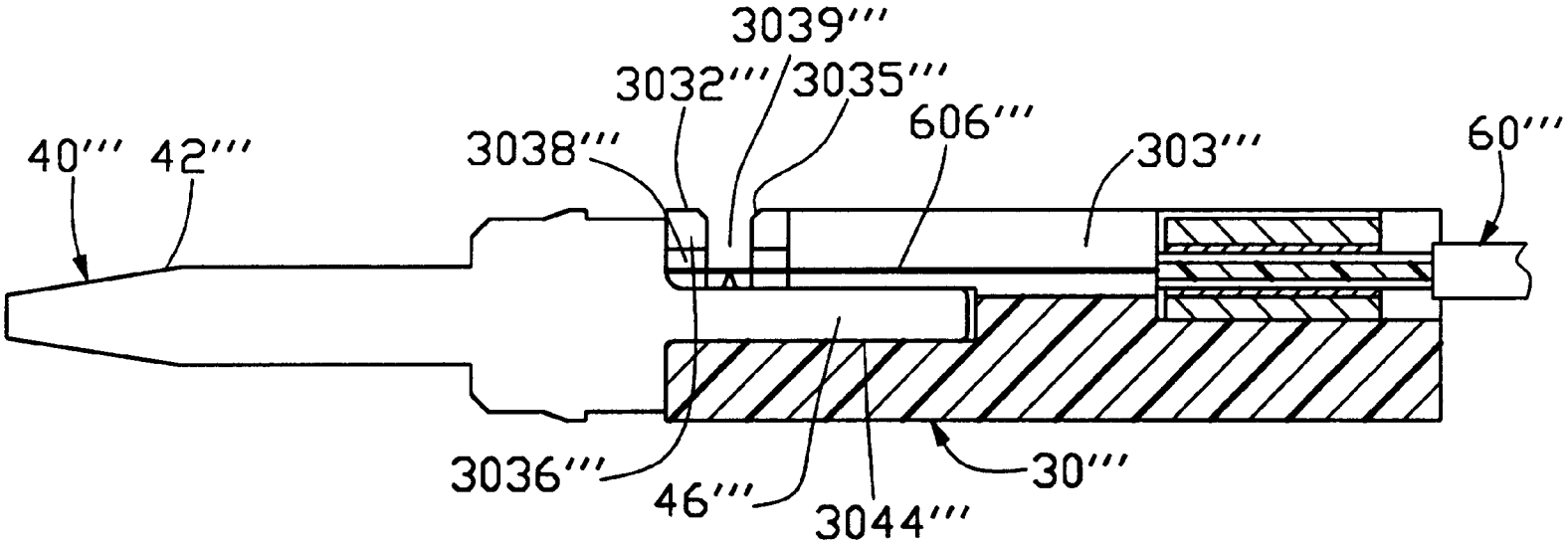
FIG. 17 is a partly cross-sectional view of the micro connector assembly of FIG. 16.

A fourth embodiment of the present invention as shown in FIGS. 15–17 additionally defines an elongated slit 3039''' extending transversely and normally of the lateral sides of the passageways 303''', i.e., normally of the partition between every adjacent two passageways 303''', in comparison with said first embodiment shown in FIGS. 3, 5 & 6. Optionally, the slit 3039''' also normally extends through the pair of protrusions 3032''' on the lateral sides of the passageways 303''' thereby constituting an entrance of an external tool like a metal plate 70''' shown in FIG. 16.

As aforementioned regarding the first embodiment, the signal segments 606''' of the cables 60''' can enter the corresponding passageways 303''' and are located above the tail sections 46''' of the corresponding contacts 40''' by means of guiding of the slope surface 3036''' of the protrusions 3032'''. However, it is hard to inspect whether the tail sections 46''' of the contacts 40''' respectively make an efficient engagement with the signal segments 606''' of the corresponding cables 60''' within the passageways 303''', which provides a sufficient soldering region, because of the micro dimensions thereof. If the signal segments 606''' of the cables 60''' are basically unengaged with the tail sections 46''' of the contacts 40''', an inefficient/a disconnective soldering will be made therebetween.

Therefore, the metal plate 70''' is supposed to orient both the tail sections 46''' of the contacts 40''' and the signal segments 606''' of the cables 60''' at an appropriate position within the corresponding passageways 303''', which is properly dimensioned in depth, when depressing the signal segments 606''' down through the slit 3039'''. At the same time, an efficient mechanical engagement of the tail sections 46''' of the contacts 40''' with the signal segments 606''' of the cables 60''' can be approached before the soldering process or conductive adhesives exercised therebetween. Optionally, a second slope surface 3035''' is jointed normally with the first slope surface 3036''' of each protrusion 3032''', as on opposite sides of the slit 3039''', thereby guiding the metal plate 70''' into the slit 3039'''.

It is understandable that the metal plate 70''' have to be removed out of the slit 3039''' before the soldering process is exercised. And, any other plate-like substitute with the same thickness and the widths can be used to replace the metal plate 70'''.

In fact, the fourth embodiment offers a multi-directional orientating means for convenience of soldering the signal segment 606''' of the cables 60''' with the tail sections 46''' of the corresponding contacts 40''', including the orientation of the protrusions 3032''' in a horizontal direction, and the orientation of the slit 3039 ''' in a vertical direction.

It is understandable that an external withdrawing force exercised on the cable connector can be eliminated by the interference fit between the contacts and the housing and the locking between the latch portion and the bow section, rather than the tight fit between the contacts and the cable of the prior arts. Therefore, the electrical and mechanical connection between the contacts and cable is directly harmed.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

We claim:

1. A cable connector assembly with a plurality of juxtaposed cables for mating with an external mating connector, comprising:

an insulative housing defining a plurality of passageways in a front-to-back direction thereof, each of the passageways defined with opposite lateral sides;

a plurality of contacts each including a contact section at a free end for electrical contact with the mating connector, and a tail section at an opposed end thereof snugly received within the corresponding passageway of the housing; and a plurality of juxtaposed cables each having at least a conductive signal segment at a free end thereof wherein an elongated slit defined normally through the lateral sides of the passageways to permit the entrance and removal of an external tool thereby fixedly orienting the tail sections of the contacts and the signal segments of the cables within the corresponding passageways, and to ensure the electrical and mechanical engagement between the tail sections of the contacts and the signal segments of the cables before a soldering process or use of conductive adhesives;

wherein a pair of protrusions respectively formed on the opposite lateral sides of each passageway efficiently guide the signal segment of the respective cable to enter the same passageway above the tail section of the corresponding contact;

wherein the slit extends normally through the protrusions of each of the passageways.

* * * * *